US005178204A

United States Patent [19]

Kelly et al.

[11] Patent Number: 5,178,204

[45] Date of Patent: Jan. 12, 1993

[54] METHOD AND APPARATUS FOR RHEOCASTING

[76] Inventors: James E. Kelly, 1429 N. Arbogast, No. OG, Griffith, Ind. 46319; Kenneth E. Blazek, 3409 W. Lakeshore Dr., Crown Point, Ind. 46307; Kenneth P. Young, 31270 Eagle Crest La., Evergreen, Colo. 80439

[21] Appl. No.: 865,710

[22] Filed: Apr. 8, 1992

Related U.S. Application Data

[63] Continuation of Ser. No. 624,647, Dec. 10, 1990, abandoned.

[51] Int. Cl.[5] ..... B22D 27/02

[52] U.S. Cl. ..... 164/468; 164/504; 164/900; 164/415

[58] Field of Search ..... 164/466, 468, 502, 504, 164/475, 499, 147.1, 900, 418, 439, 415

[56] References Cited

U.S. PATENT DOCUMENTS

| | | | |
|---|---|---|---|
| 3,902,544 | 9/1975 | Flemings et al. | 164/71 |
| 3,948,650 | 4/1976 | Flemings et al. | 75/135 |
| 4,089,680 | 5/1978 | Flemings et al. | 75/129 |
| 4,155,398 | 5/1979 | Trentini et al. | 164/468 |
| 4,229,210 | 10/1980 | Winter et al. | 75/10 |
| 4,434,837 | 3/1984 | Winter et al. | 164/468 |
| 4,457,354 | 7/1984 | Dantzig et al. | 164/468 |
| 4,457,355 | 7/1984 | Winter et al. | 164/468 |
| 4,482,012 | 11/1984 | Young et al. | 165/146 |
| 4,537,242 | 8/1985 | Pryor et al. | 164/460 |

FOREIGN PATENT DOCUMENTS

| | | | |
|---|---|---|---|
| 64-66053 | 3/1989 | Japan | 164/468 |
| 2274345 | 11/1990 | Japan . | |

*Primary Examiner*—Kuang Y. Lin

[57] ABSTRACT

A method and apparatus for rheocasting (slurry casting) molten metal employ a stirring chamber located upstream of a casting mold. Electromagnetic stirring is employed in both the stirring chamber and the casting mold. Structure is provided for minimizing secondary recirculating flows in the molten metal as it flows downstream through the apparatus, for preventing hangers and for eliminating the columnar dendritic zone at the periphery of the casting. The efficiency of utilization of the magnetic field is optimized as is the agitation required for producing a desired fine, spheroidal, degenerate dendritic grain structure in the solidified casting.

35 Claims, 3 Drawing Sheets

METHOD AND APPARATUS FOR RHEOCASTING

This application is a continuation of application Ser. No. 07/624,647, filed Dec. 10, 1990, now abandoned.

BACKGROUND OF THE INVENTION

The present invention relates generally to methods and apparatuses for solidifying molten metal and more particularly to methods and apparatuses for doing so employing rheocasting. Rheocasting, also known as slurry casting, is a procedure in which molten metal is subjected to vigorous agitation as it undergoes solidification. Absent such agitation, dendrites would form as the metal solidifies. A dendrite is a solidified particle shaped like an elongated stem having transverse branches extending therefrom.

Vigorous agitation converts the normally dendritic microstructure of the solidifying metal into a non-dendritic form comprising discrete, degenerate dendrites in a liquid matrix. The agitation, which may be either mechanical or electromagnetic, shears the tips of the solidifying dendrites, and this produces a metal slurry composed of relatively fine, spheroidal, non-dendritic particles or grains in a liquid matrix.

The rheocast material is typically fully solidified, then reheated to a semi-solid state temperature, and then subjected to forming under pressure, e.g. die forming. When the material is in a semi-solid state, it has a microstructure composed of solid particles in a liquid matrix.

It is desirable that there be a relatively fine grain size when metallic material is formed under pressure while in a semi-solid state. Fine grains or particles flow more readily than do coarse grains during forming under pressure in a semi-solid state. For example, one desirable steel microstructure for semi-solid forming has an aim austenitic grain size, when in a solid state, of no greater than about 150 microns.

A procedure in which molten metallic material is solidified by rheocasting and then reheated to a semi-solid state followed by forming under pressure is disclosed in Young U.S. Pat. No. 4,565,241. This patent discloses maintaining, within a specified range, the ratio between (a) the shear rate of the metal undergoing agitation and (b) the solidification rate of that metal. Doing so produces certain desired results from the standpoint of microstructure and forming costs. Either mechanical or electromagnetic agitation are contemplated.

The shear rate obtained with mechanical agitation may be ascertained with reasonable accuracy. However, that is not the case when electromagnetic agitation is employed; in such a case, complex mathematical models are required to calculate the shear rate. These models require one to estimate the viscosity of the metal undergoing rheocasting, and that viscosity depends largely upon the proportion of solid phase in the metal undergoing rheocasting. The proportion of solid phase can vary from 0 to 80%, and over that range of solid phase, the viscosity can vary over several orders of magnitude. As a result, the calculated value of the shear rate can vary over several orders of magnitude depending upon the estimated viscosity of the metal undergoing rheocasting.

Another consideration involved in the electromagnetic stirring of molten metal undergoing rheocasting is the efficiency with which the electromagnetic field is employed. Rheocasting typically employs a casting mold having open upstream and downstream ends, and rheocasting can be a continuous type of casting. Copper alloys having high thermal conductivities are the only materials that have been found suitable for constructing molds employed in the rheocasting of metals such as steel. The lower conductivities of other materials cause excessive thermal distortion. However, the electrical conductivities of copper alloys are almost directly proportional to their thermal conductivities. As a result, when a rheocasting mold is made from materials conventionally employed for that purpose, there is produced a very effective shield to electromagnetic stirring fields.

To overcome this shielding effect, it has been conventional to use electromagnetic stirring fields with a frequency of 10 Hertz or less when stirring steel in a continuous casting mold. However, with such low electromagnetic stirring frequencies, the angular velocity of the molten metal within the mold is relatively low, e.g. no greater than about 10 revolutions per second. In rheocasting, it would be desirable to use an electromagnetic stirring field having frequencies of 30 to 60 Hertz, preferably at the upper end of that range.

In the rheocasting of steel, the molten steel can form a continuous column of liquid many meters long. Generally, an electromagnetic stirrer will extend over only a small portion of the liquid column. The stirring effect of such a device will extend up to 15 diameters upstream and downstream of the stirring device due to secondary recirculating flows. Primary circulatory flow occurs in planes transverse to the axis of the column of molten metal, while secondary recirculating flows occur in planes transverse to the planes in which primary circulatory flow occurs. The secondary flows will absorb about half of the stirring energy introduced into the metal column and thus reduce the maximum rotational or angular velocity that can be imparted to the material undergoing agitation. Therefore reducing the secondary recirculating flows is a desirable aim because it conserves the stirring energy available from primary circulatory flow.

Another problem which can arise in a rheocasting process is the occurrence of hangers. A hanger is a solidified peripheral skin which hangs up on the walls of the casting mold or confinement chamber in which solidification begins, rather than moving downstream at the same rate as the rest of the metal undergoing solidification. This can result in a breakout at the outlet of the casting mold, i.e. molten metal leaking through the skin of the partially solidified metal.

A third problem which can arise in a rheocasting process is the occurrence of a columnar, dendritic zone at the periphery of the casting. This peripheral, columnar, dendritic zone has a structure that is unsuitable for forming in the semi-solid state and thus reduces the yield of rheocast feedstock obtained from the rheocasting process.

SUMMARY OF THE INVENTION

The present invention employs processing conditions and apparatus features which eliminate or minimize the problems discussed above.

In one embodiment, an apparatus in accordance with the present invention comprises a casting mold having an inlet and an outlet. A stirring chamber, which may have interior walls composed of refractory material, is located upstream of the continuous casting mold. The stirring chamber has an inlet for receiving molten metal, e.g. from a tundish, and an outlet aligned with the inlet of the mold. A magnetic stirring element is disposed around the chamber, and there is at least one other magnetic stirring element disposed around the mold. A linear conduit composed of refractory material extends between the outlet of the stirring chamber and the inlet of the mold, for confining molten metal flowing from the stirring chamber into the mold.

The apparatus produces a degenerate dendritic microstructure comprising substantially spheroidal grains having a relatively fine grain size. This desirable microstructure is provided utilizing electromagnetic agitation and a combination of processing conditions which are controlled in accordance with an equation which does not require the use of complex mathematical models to calculate the shear rate produced by the electromagnetic agitation. All of the parameters entering into the equation (to be described subsequently in detail in the detailed description) can be readily determined with reasonable accuracy.

The casting mold employed in the apparatus allows one to use a magnetic frequency, for stirring purposes, up to about 60 Hertz, while permitting at least 50% of the magnetic field developed by the electromagnetic stirring element to penetrate to the interior of the mold. These advantages are a result of the particular dimensions of the mold and of the particular metallic material of which the mold is composed. In operation, the mold provides a desirable combination of thermal conductivity, for heat extraction purposes, and magnetic field efficiency for agitation purposes.

In the mold, a solid, peripheral skin is solidified around the metal slurry in the mold. Structure is provided for preventing the solid peripheral skin in the mold from extending upstream beyond a predetermined level, an occurrence which could cause undesirable hangers to form. In one embodiment, there is a ceramic break ring sandwiched between (a) the downstream end of the conduit which communicates with the mold and (b) the upstream end of the mold. The break ring is used together with a procedure in which the downstream flow of the metallic material through the casting mold is stopped, reversed, and then reinitiated. This procedure breaks up any hangers which may have a tendency to form at the location of the ceramic break ring.

In another embodiment of mold which prevents the formation of hangers, the upstream end portion of the mold includes structure which defines an annular space surrounding the column of metallic material flowing through the upstream end portion of the mold. An inert gas is introduced into this annular space to prevent molten metal from entering that space. This in turn prevents hangers from forming at the upstream end portion of the mold.

Electromagnetic agitation of the molten metal within the mold creates turbulence which can cause the molten metal to splash upstream into the annular space described in the preceding paragraph. Additional structure is provided to minimize that splashing.

The stirring chamber includes heat-extracting structure capable of forming a solid peripheral skin around the molten metal in that chamber. In a further embodiment of the present invention, structure is provided which prevents any solid peripheral skin which forms in the stirring chamber from growing downstream into the conduit which communicates the stirring chamber with the mold. This structure is typically in the form of a constriction at the downstream end of the stirring chamber.

As noted above, at least one electromagnetic stirring element is disposed around each of the stirring chamber and the continuous casting mold. Each magnetic stirring element induces, in the adjacent downstream-flowing volume of molten metal, a primary circulatory flow in a first rotational sense. Associated with each of these primary electromagnetic stirring elements is structure for substantially reducing secondary recirculating flows caused in the volume of molten metal by the primary electromagnetic stirring element.

One embodiment of such structure employs at least one additional electromagnetic element linearly aligned with and spaced from the primary magnetic stirring element. This additional electromagnetic element may be either (a) an electromagnetic brake or (b) another electromagnetic stirring element for inducing, in the downstream-flowing volume of molten metal, primary circulatory flow in a rotational sense opposite that induced by the primary electromagnetic stirring element. One such additional electromagnetic element may be located upstream of the primary electromagnetic stirring element, and another additional electromagnetic element may be located downstream of the primary electromagnetic stirring element.

Another embodiment of structure for preventing secondary recirculating flow, in the stirring chamber, comprises (a) an upstream constriction in the stirring chamber at a location not substantially further upstream than the upstream end of the electromagnetic stirring element and (b) a downstream constriction in the stirring chamber at a location not substantially further downstream than the downstream end of the electromagnetic stirring element. Each of the constrictions defines an opening for molten metal passage, and each of those openings has a cross-sectional area substantially less than the cross-sectional area of the stirring chamber between the upstream and downstream constrictions.

Other features and advantages are inherent in the apparatus and methods claimed and disclosed or will become apparent to those skilled in the art from the following detailed description in conjunction with the accompanying diagrammatic drawings.

DETAILED DESCRIPTION

Figure 1:
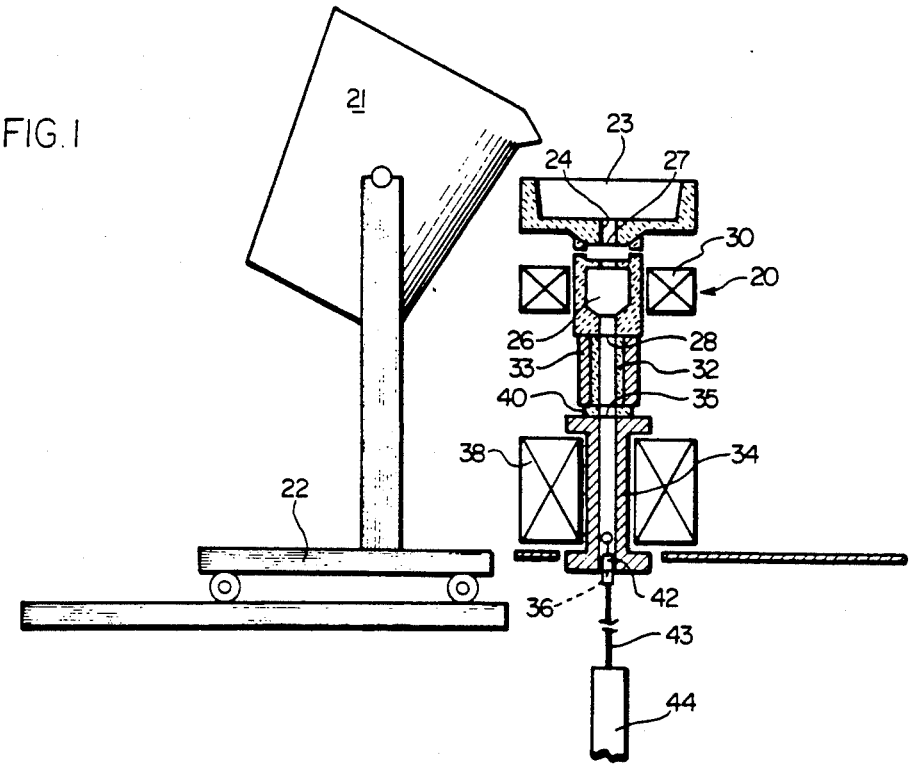
FIG. 1 is an elevational view, partially in section, illustrating an embodiment of apparatus in accordance with the present invention.

Referring initially to FIG. 1, indicated generally at 20 is a rheocasting apparatus constructed in accordance with an embodiment of the present invention. Apparatus 20 is associated with a ladle 21, mounted on a ladle car 22, for pouring molten metal, such as molten steel, into a tundish 23, from which the molten metal exits through a tundish outlet 24 into rheocasting apparatus 20.

In the embodiment illustrated herein, rheocasting apparatus 20 comprises a vertically disposed, casting mold 34 having an upper inlet 35 and a lower outlet 36. Located above mold 34 is a vertically disposed stirring chamber 26 having interior walls composed of refractory material, stainless steel or other suitable material. Although not shown in FIG. 1, stirring chamber 26 is typically enclosed within a water cooled, stainless steel shell or jacket. Stirring chamber 26 has an upper inlet 27 for receiving molten metal from tundish 23 and a lower outlet 28 vertically aligned with inlet 35 of mold 34. A magnetic stirring element 30 is disposed around the stirring chamber, and there is at least one other magnetic stirring element 38 disposed around mold 34. The linear dimension between the upstream and downstream ends of magnetic stirring element 30 is substantially less than the linear distance between the stirring chamber's upper inlet 27 and the casting mold's lower outlet 36. A vertically disposed conduit 32 composed of refractory material extends between outlet 28 of stirring chamber 26 and inlet 35 of mold 34, for confining molten metal descending from the stirring chamber into the mold. Conduit 32 may be enclosed within a metal shell 33. The stirring chamber and the casting mold, as well as the conduit extending between the two, are typically cylindrical in cross-section.

Extending upwardly through outlet 36 of mold 34 is a dummy element 42 connected by a rod 43 to a withdrawal mechanism 44 which can be hydraulic or electrically powered.

When a casting operation begins, molten metal is poured from ladle 21 into tundish 23 from which the molten metal descends, in sequence, through stirring chamber 26 and conduit 32 into mold 34. A solid casting bottom forms at dummy element 42 which is withdrawn from casting mold outlet 36 by withdrawal mechanism 44 to allow a partially solidified casting, typically having a solid peripheral skin and metal slurry interior, to exit from mold 34. Solidification of the casting's interior proceeds to completion either inside or outside mold 34, and in the latter case, solidification may be assisted by employing an external cooling medium, such as water sprays, in a conventional manner.

Typically, a slurry of solid particles in molten metal is contained within the solidified peripheral skin of the casting in mold 34, and that slurry is stirred by electromagnetic stirring element 38. Stirring chamber 26 contains molten metal or a slurry of solid particles in molten metal, and the molten metal or slurry undergoes stirring in chamber 26 by electromagnetic stirring element 30. Both electromagnetic stirring elements 30 and 38 have two poles and are of conventional construction.

A solidified casting produced by apparatus 20 has a degenerate dendritic microstructure comprising substantially spheroidal grains having a relatively fine grain size. This microstructure is the result, at least in part, of the electromagnetic agitation the metal undergoes in stirring chamber 26 and mold 34. Other features of the present invention which contribute to the desirable microstructure described two sentences above will be described subsequently.

There is a descending vertical column of metal which is totally or partially molten extending all the way from stirring chamber inlet 27 to mold outlet 36. The agitation caused by the stirring chamber's electromagnetic stirring element 30 creates primary circulatory flow within stirring chamber 26, and the agitation caused in the molten metal within mold 34 by electromagnetic stirring element 38 creates primary circulatory flow within mold 34. Primary circulatory flow occurs in planes transverse to the vertical axis of the column of molten metal.

Figure 2:
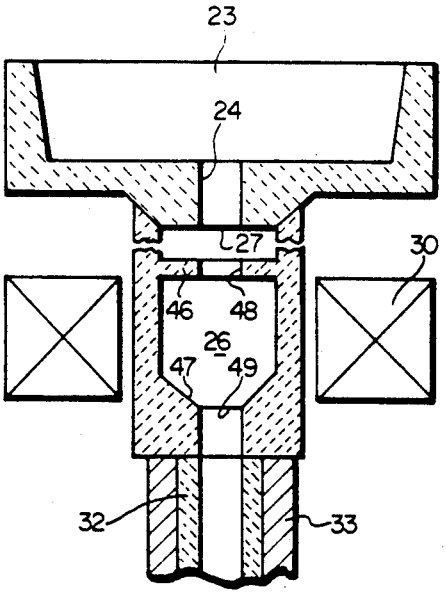
FIG. 2 is an enlarged, fragmentary, vertical sectional view of part of the apparatus illustrated in FIG. 1.
Figure 3:
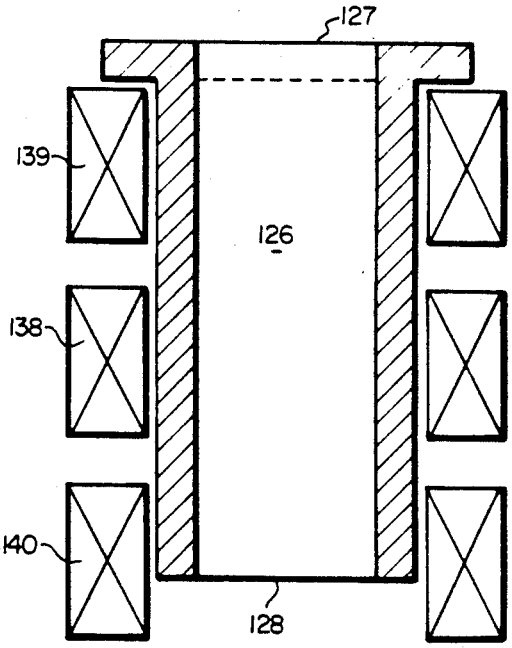
FIG. 3 is an enlarged, vertical sectional view of another part of an apparatus in accordance with an embodiment of the present invention.

Primary circulatory flow is not the only stirring effect caused by each of the electromagnetic stirring elements. In addition, there are secondary recirculating flows which extend above and below the location of primary circulatory flow, in planes transverse to the planes in which primary circulatory flow occurs. The stirring effects may have a total vertical extent of up to 15 diameters, extending both above and below the location of the electromagnetic stirring element which produces the primary circulatory flow. Secondary recirculating flows are undesirable because they will absorb a substantial part (e.g. about one-half) of the stirring energy introduced into the material undergoing stirring and thus reduce the maximum rotational or angular velocity that can be imparted to that material. FIGS. 2 and 3 illustrate structure for reducing secondary recirculating flows.

With reference to FIG. 2, there is an upper constriction 46 in stirring chamber 26 at a vertical level not substantially higher than the vertical level of the upper end of magnetic stirring element 30. There is also a lower constriction 47 in chamber 26 at a vertical level not substantially lower than the vertical level of the lower end of electromagnetic stirring element 30. Upper constriction 46 has an opening 48, and lower constriction 47 has an opening 49. Each of openings 48, 49 have a cross-sectional area substantially less than the cross-sectional area of chamber 26 between upper and lower constrictions 46, 47 respectively. Constrictions 46 and 47 reduce secondary recirculating flows caused by electromagnetic stirring element 30.

The stirring chamber's lower constriction may be at the lower outlet of the stirring chamber, and the stirring chamber's upper constriction may be at the upper inlet of the stirring chamber. The cross-sectional area of the opening in the lower constriction is between about $\frac{1}{4}$ and about $\frac{1}{2}$ of the cross-sectional area of the chamber. The cross-sectional area of the opening in the upper constriction is substantially the same as the cross-sectional area of the opening in the lower constriction, in preferred embodiments.

The expedients described in connection with FIG. 2 for reducing secondary recirculating flows are applicable only to a stirring chamber but not to a mold.

FIG. 3 illustrates an expedient which may be applicable to either a stirring chamber or a mold, to reduce the secondary recirculating flows. In FIG. 3, there is shown a confining chamber 126 having an upper inlet 127 and a lower outlet 128, without constrictions anywhere in the chamber. Disposed around chamber 126 is a first electromagnetic stirring element 138. Also associated with chamber 126 is at least one additional electromagnetic element vertically aligned with and spaced from electromagnetic stirring element 138. The additional electromagnetic stirring elements are at 139 and 140 in FIG. 3.

An electromagnetic element such as 139 or 140 may be in the form of a magnetic brake, or it may be in the form of another electromagnetic stirring element for inducing in the molten metal within chamber 126 a primary circulatory flow which (a) rotates in a sense opposite that induced by electromagnetic stirring element 138 and (b) is located at the level of element 139 or 140. If the additional electromagnetic element is in the form of a magnetic brake, no primary circulatory flow is induced into the molten metal by that particular electromagnetic element, but the brake does substantially reduce the secondary recirculating flows at the level of the brake. An electromagnetic brake employs a DC field which stops or reduces the secondary recirculating flows but cannot create a primary circulatory flow itself.

The employment of electromagnetic elements, such as 139 and 140 above and/or below the principal electromagnetic stirring element, to prevent secondary recirculating flows, is useful not only with a stirring chamber but also with a casting mold such as mold 34. In such a case, the multiplicity of electromagnetic elements 138–140 would replace the single electromagnetic stirring element 38 illustrated in FIG. 1.

Solidification of the molten steel occurs primarily in mold 34, although some solidification can occur in the stirring chamber. It is desirable to form a peripheral skin in mold 34. It is undesirable to form a peripheral skin in the stirring chamber, or anywhere upstream of mold 34. Solidification in the stirring chamber can be anywhere from 0 to 50%, for example, depending upon the thickness of the refractory walls of which the interior of the stirring chamber is composed, and upon the temperature of the cooling fluid which is circulated through the stainless steel water jacket which typically encloses the stirring chamber. To the extent that solidification occurs in the stirring chamber, it is desirable to confine such solidification, as much as possible, to solid particles which form part of a slurry, composed of molten metal and solidified metal particles, and which undergoes agitation in the stirring chamber and exits the stirring chamber in that form.

A variation of the procedure described above can be employed to prevent the formation of columnar dendrites extending into the interior of mold 34 from the inside surface of the mold walls. The formation of columnar dendrites is particularly a problem when the metal is undergoing rheocasting. Preventing the formation of such dendrites is accomplished by cooling the metal undergoing agitation in the separate stirring chamber upstream of the casting mold so as to deliver to mold 34 an agitated volume of cooled metal consisting essentially of primarily molten metal with 0–30 wt. % solid metal which, when present, is in the form of particles which form a slurry with the molten metal, as described above. Preferably the metal is at a temperature below the liquidus temperature when it enters the casting mold. The procedure described in this paragraph is applicable to ferrous alloys, for example.

Care must be taken to avoid hangers in the casting mold and upstream of the casting mold, and various embodiments of structure for doing so will now be described in connection with FIGS. 4–7.

Figure 4:
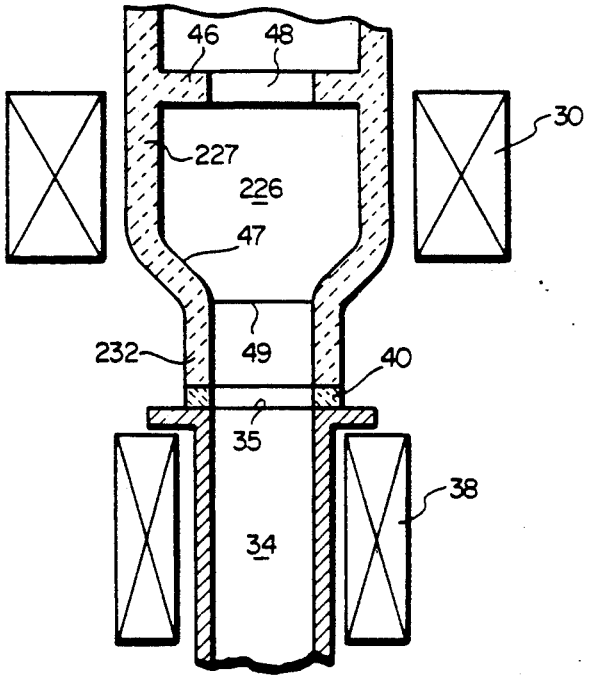
FIG. 4 is a fragmentary, vertical sectional view of part of an apparatus in accordance with another embodiment of the present invention.

Referring initially to FIG. 4, a stirring chamber 226 has a constriction 47 at the outlet of the stirring chamber, and the constriction has an opening 49 communicating with a conduit 232 in turn communicating with casting mold 34. A ceramic break ring 40 is located between upper inlet 35 of casting mold 34 and the lower end of conduit 232.

Stirring chamber 226 can be composed of a refractory substrate, or some other suitable substrate, and the substrate is typically surrounded by a water cooled, stainless steel cooling jacket (not shown in FIG. 4). Conduit 232 is composed of refractory material of sufficient thickness to prevent any substantial solidification from occurring in the conduit.

Stirring chamber 226 has vertically disposed sidewalls 227 extending upwardly from constriction 47. Depending upon the extent of cooling which takes place in stirring chamber 226, it is possible for a peripheral skin to solidify within chamber 226 at sidewalls 227. Constriction 47 prevents any solid peripheral skin which may form at wall 227 from growing downwardly into conduit 232, and this assists in preventing the formation of hangers upstream of mold 34.

The descending column of metal undergoes virtually no cooling as it descends through refractory conduit 232 which is heavily insulated. Mold 34, however, is composed of a highly thermally conductive material, such as copper or copper alloy, and the mold is cooled by cooling coils (not shown in FIG. 4). Therefore, as the hot metal enters mold 34, there is (1) a substantial chilling effect on the metal at upper inlet 35 of mold 34 and (2) the danger of hanger formation at the upper end portion of mold 34. A number of expedients are utilized to prevent the formation of such hangers.

In one instance, as shown in FIG. 4, a ceramic break ring 40 is employed, either alone or together with a procedure in which the descent of metallic material through the mold is stopped, reversed, and then reinitiated, employing the withdrawal mechanism 44 and associated structure 42, 43 shown in FIG. 1. The procedure described in the preceding sentence breaks up any hangers which may have a tendency to form at the location of the ceramic break ring. This procedure can be repeated periodically throughout the casting operation to minimize the formation of hangers at the upper end portion of mold 34. The ceramic break ring also prevents any solid peripheral skin which forms at the top of mold 34 from extending upwardly beyond ring 40, an occurrence which would be undesirable.

Figure 5:
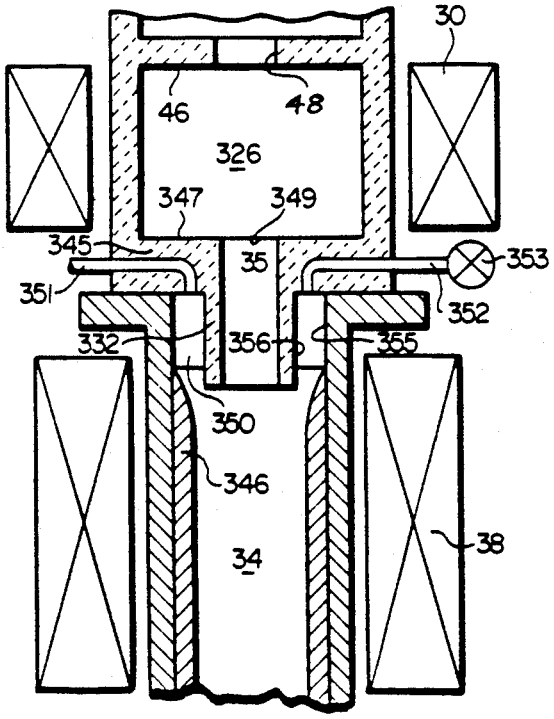
FIG. 5 is a fragmentary, vertical sectional view of part of an apparatus in accordance with a further embodiment of the present invention.

Another expedient for preventing the formation of hangers at the upper end portion of mold 34 is illustrated in FIG. 5. A stirring chamber 326 has a lower constriction 347 with an opening 349 communicating with a conduit 332 extending downwardly through the upper inlet 35 of mold 34. At least a portion of conduit 332 extends downwardly into the upper portion of mold 34, or the entire conduit may do so, as shown in FIG. 5. Mold 34 includes an upper portion having an inner surface 355. There is an outer surface 356 on that portion of conduit 332 which extends into the upper portion of mold 34. Outer conduit surface 356 and inner mold surface 355 define between them a substantially annular space 350. Communicating with annular space 350 is an inlet conduit 351 which extends through a bottom wall 345 of stirring chamber 326. Also communicating with annular space 350 is an outlet conduit 352 which, like inlet conduit 351, extends through bottom wall 345 of stirring chamber 326. Outlet conduit 352 communicates with a pressure relief valve 353. Inlet conduit 351 communicates with a source of pressurized gas (not shown).

Pressurized gas is introduced through inlet 351 into annular space 350, and the resulting pressure in annular space 350 is sufficient to prevent molten metal in mold 34 from rising into annular space 350, thereby preventing the formation of a peripheral skin therein, and minimizing the danger of hangers forming at the upper end portion of mold 34. Any peripheral skin which does solidify within mold 34 is located for the most part below annular space 350, as shown at 346 in FIG. 5. The pressurized gas can be withdrawn from annular space 350 by opening valve 353 on outlet conduit 352.

Figure 6:
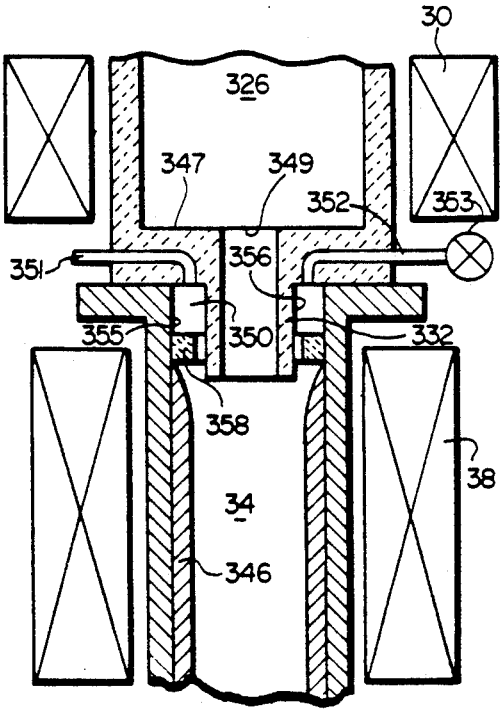
FIG. 6 is a fragmentary, vertical sectional view of part of an apparatus in accordance with still a further embodiment of the present invention.

Molten metal within mold 34 is subjected to agitation by electromagnetic stirring element 38. Such agitation creates turbulence in the molten metal within mold 34, and this may cause the molten metal to splash upwardly into annular space 350. Structure to minimize that splashing is shown in FIG. 6.

More particularly, extending inwardly from interior surface 355 of the mold's upper portion, adjacent the lower end of peripheral space 350, is a lip 358 composed of refractory material. Lip 358 is in the form of a ring having an interior opening through which extends conduit 332. Lip 358 provides a barrier which prevents molten metal below the lip from splashing upwardly into annular space 350.

Figure 7:
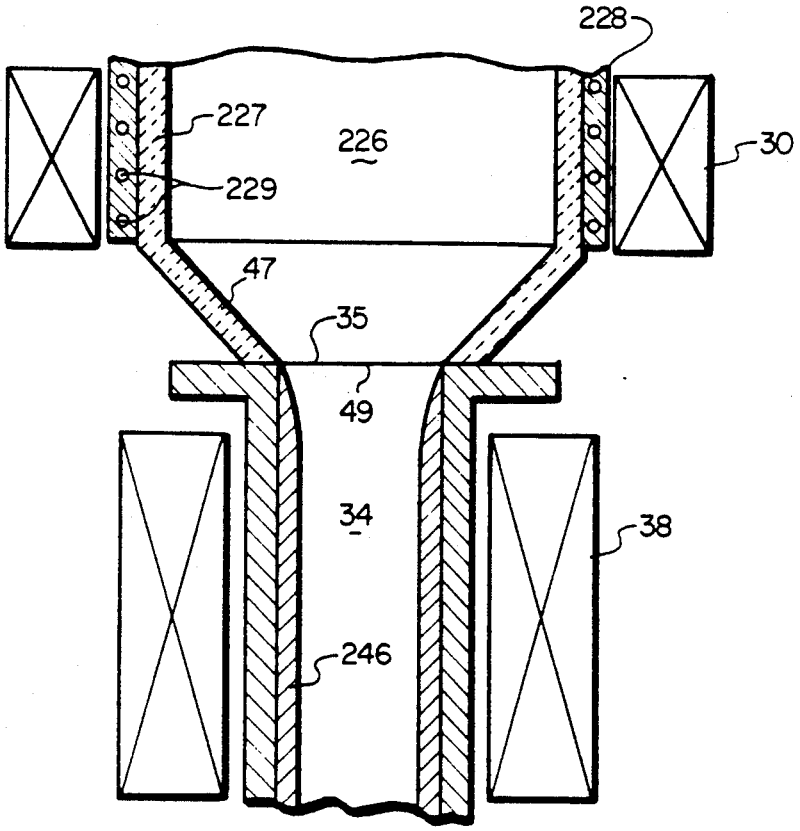
FIG. 7 is a fragmentary, vertical sectional view of part of an apparatus in accordance with yet another embodiment of the present invention.

Referring now to FIG. 7, in the embodiment illustrated therein, stirring chamber 226 has a lower constriction 47, as in the embodiment illustrated in FIG. 4, but outlet opening 49 at the bottom of constriction 47 does not communicate with a conduit, such as 232 in the embodiment of FIG. 4. Instead, outlet opening 49 communicates directly with upper inlet 35 of mold 34, there being no ceramic break ring at the top of mold 34, as there is at 40 in the embodiment of FIG. 4. In the embodiment of FIG. 7, hangers are prevented from occurring at the top of mold 34 by employing the procedure, described above, in which the descent of metallic material through the mold is stopped, reversed, and then reinitiated. Moreover, as was described in connection with stirring chamber 226 illustrated in FIG. 4, any peripheral skin which may solidify on stirring chamber wall 227 in FIG. 7 is prevented from descending further downwardly by constriction 47.

Stirring chamber 226 in FIG. 7 is illustrated as having a refractory substrate with a stainless steel water jacket 228 containing passages 229 for circulating cooling water.

Figure 8:
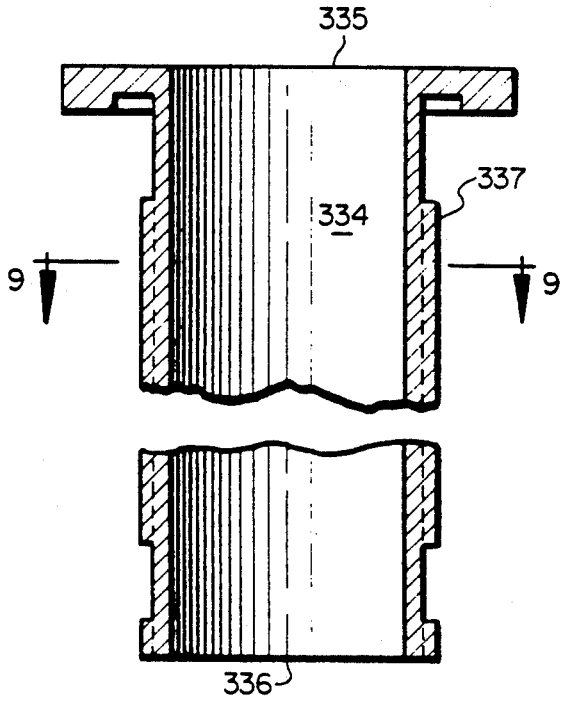
FIG. 8 is a vertical sectional view illustrating an embodiment of a casting mold in accordance with the present invention.
Figure 9:
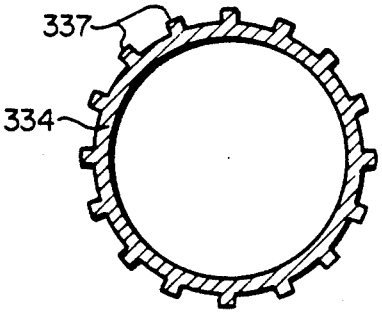
FIG. 9 is a sectional view taken along line 9—9 in FIG. 8.

Referring now to FIGS. 8 and 9, there is illustrated an embodiment of a mold 334 constructed in accordance with the present invention. Mold 334 has an upper inlet 335, a lower outlet 336 and vertically disposed peripheral ribs 337 containing passages (not shown) for circulating a cooling fluid, such as water. Mold 334 is cylindrical and has a diameter (D) no more than about 152 mm (6 in.). The wall thickness (t) of the cylinder, excluding ribs 337, is between about 1.6 and 4.8 mm (1/16–3/16 in.).

Mold 334 is composed of a metallic material having a conductivity no greater than about $0.29\times10^8$ (ohm m)$^{-1}$. A preferred example of such a metallic material consists essentially of, in wt. %:

| | |
|---|---|
| Be | 0.55 |
| Co | 2.4 |
| Zr | 0.25 |
| Cu | balance. |

Like the casting molds illustrated in FIGS. 1 and 4–7, mold 334 is surrounded by at least one electromagnetic stirring element, such as 38 in FIGS. 1 and 4–7. Although mold 334 is composed of a copper alloy having a high thermal conductivity, as well as a high electrical conductivity, mold 334 does not have the problem of low magnetic field efficiency associated with other molds composed of copper base alloy. As a result, the electromagnetic stirring elements associated with mold 334 may be operated at an electromagnetic stirring field frequency of 30 to 60 Hertz, preferably at the upper end of that range. When doing so, the mold allows at least 50% of the magnetic field developed by the electromagnetic stirring element to penetrate to the interior of the mold, even when employing a frequency of about 60 Hertz. This is due to the combination of mold dimensions and metallic composition described above. Such a mold will provide a magnetic skin depth of at least about ½ in. (12.7 mm) when one employs a magnetic frequency, at the electromagnetic stirring element, of about 60 Hertz. To ensure that at least 50% of the magnetic field penetrates the mold, the parameter $D^2t^2/4(d)^4$ must be less than 3, where D and t are the mold diameter and thickness, respectively, and d is the skin depth of the magnetic field in the mold.

The skin depth of the magnetic field is inversely proportional to the square root of the multiplication product of (a) the electrical conductivity of the mold material times (b) the angular frequency of the stirring field. The angular frequency, in radians per second, is equal to the magnetic frequency in Hertz times 2 $\pi$. One revolution equals 2 $\pi$ radians. The skin depth should be at least about 12.7 mm (½ in.) when employing an electromagnetic frequency of about 60 Hertz, and this requires that the mold be composed of a metallic material having the conductivity noted above.

In summary, a magnetic field efficiency of at least 50% is obtained when the mold diameter is no greater than about 6 inches (152 mm), the thickness of the mold wall is in the range 1/16–3/16 in. (1.6 to 4.8 mm), and the skin depth of the magnetic field in the mold is greater than about ½ in. (12.7 mm). The skin depth will meet the requirements noted in the preceding sentence when (a) the mold is composed of a metallic material having a conductivity no greater than about $0.29\times10^8$ (ohm m)$^{-1}$ and (b) the angular frequency of the stirring field corresponds to an electromagnetic frequency of 60 Hertz, i.e. 120 $\pi$ radians per second.

Within an electromagnetic frequency range of 30–60 Hertz, the higher the electromagnetic frequency, the higher the angular stirring frequency within the mold. Above a frequency of 60 Hertz, there is too large a loss in efficiency of utilization of the magnetic field. Below about 30 Hertz, there is too large a drop in the agitation or stirring produced within the mold. An electromagnetic frequency within the range 30–60 Hertz provides a desired efficiency of utilization of the magnetic field together with a desired amount of agitation, provided all of the other parameters noted below are employed. The electromagnetic field intensity in both the stirring chamber and the mold should be in the range 400 to 3,000 Gauss for a 60 Hertz stirring field.

The various embodiments of apparatus described above produce a degenerate, dendritic microstructure comprising substantially spheroidal grains having a relatively fine grain size. This desirable microstructure is provided by utilizing electromagnetic agitation and a combination of processing conditions which are controlled in accordance with an equation which does not require the use of complex mathematical models to calculate the shear rate produced by the electromagnetic agitation. All of the parameters entering into the equation, described immediately below, can be readily determined with reasonable accuracy.

$$\frac{LBR}{Q}\left(\frac{\sigma\omega}{\rho}\right)^{\frac{1}{2}} > 1{,}000$$

where:

B is the magnetic field strength, in Tesla (1 Tesla=10,000 Gauss)

R is the radius, in meters, of the molten metal column undergoing stirring in the stirring zone $\sigma$ is the electrical conductivity of the molten metal, in (ohm meters)$^{-1}$ $\omega$ is the angular frequency of the stirring in the stirring zone, in radians/second $\rho$ is the density of the molten metal, in kg/m$^3$ L is the latent heat of fusion of the molten metal, in Joules/m$^3$ Q is the rate of heat extraction from the molten metal in the stirring zone, in Watts/m$^2$.

When stirring is performed in accordance with the foregoing equation, the resulting microstructure has grains which are satisfactorily rounded or spheroidal. In addition, to obtain microstructures with sufficiently small grain sizes, the following additional conditions should be satisfied:

$$\frac{RL}{Q} < 2500\ S \text{ (preferably } < 100\ S)$$

As noted above, one desirable steel microstructure for semi-solid forming has an aim austenitic grain size, when in a solid state, of no greater than about 150 microns The apparatus and methods described above produce a solidified metallic material, e.g. steel, having a cylindrical shape with a diameter of about 3 to 6 inches (76 to 152 mm). The cylindrical metallic material is subsequently cut into blanks, and the blanks can be readily formed under pressure (e.g. die forming) when heated to a semi-solid state.

The diameter of the mold is primarily determined by the diameter desired for the casting exiting from the mold, subject to lower and upper diameter limits of 3 and 6 in. (76 and 152 mm) for optimizing the efficiency of utilization of the magnetic field generated by the electromagnetic stirring element. The cross-sectional area or diameter of the stirring chamber is related to the diameter of the mold. The larger the mold diameter, the larger the diameter required for the stirring chamber. A typical stirring chamber has a diameter in the range 3–20 in. (76–508 mm), preferably 3–9 in. (76–229 mm).

The foregoing detailed description has been given for clearness of understanding only, and no unnecessary limitations should be understood therefrom, as modifications will be obvious to those skilled in the art. For example, the methods and apparatuses of the present invention are described above in the context of a vertical disposition, but they can be readily adapted, to a large extent, for employment in a horizontal disposition. In addition, many of the features and advantages described above in the context of an apparatus having a circular cross-section would be applicable to other types of cross-sections.

We claim:

1. An apparatus for use in the continuous casting of molten metal, said apparatus comprising:

a casting mold having an inlet and an outlet;

a chamber located upstream of said mold and having an inlet for receiving molten metal and an outlet vertically aligned with said inlet of the mold;

magnetic stirring means disposed around said chamber, for inducing, in molten metal contained in said chamber, a primary circulatory flow in a first rotational sense;

said magnetic stirring means having an upstream end and a downstream end and having a linear dimension between its upstream and downstream ends substantially less than the linear distance between said inlet of the chamber and said outlet of the casting mold;

and a plurality of means for substantially reducing secondary recirculating flows caused in said molten meal by said electromagnetic stirring means, to conserve the energy available from said primary circulatory flow;

said plurality of means comprising one such means adjacent said upstream end of said magnetic stirring means and another such means adjacent said downstream end of the magnetic stirring means.

2. An apparatus as recited in claim 1 wherein said means for substantially reducing said secondary recirculating flows comprises:

an upstream constriction in said chamber at a location not substantially further upstream than the upstream end of the magnetic stirring means;

and a downstream constriction in said chamber at a location not substantially further downstream than the downstream end of the magnetic stirring means;

each of said constrictions defining an opening for molten metal passage, each of said openings having a cross-sectional area substantially less than the cross-sectional area of the chamber between said upstream and downstream constrictions.

3. An apparatus as recited in claim 2 wherein:

said downstream constriction is at said outlet of the chamber.

4. An apparatus as recited in claim 2 or 3 wherein:

said upstream constriction is at said inlet of the chamber.

5. An apparatus as recited in claim 2 wherein:

said cross-sectional area of the opening in said downstream constriction is between about one-fourth and about one-half of said cross-sectional area of said chamber.

6. An apparatus as recited in claim 5 wherein:

said cross-sectional area of the opening in said upstream constriction is substantially the same as the cross-sectional area of the opening in said downstream constriction.

7. An apparatus as recited in claim 1 wherein said means for substantially reducing said secondary recirculating flows comprises:

at least one additional magnetic means aligned with and spaced from said first-recited magnetic stirring means and comprising either (a) magnetic brake means or (b) another magnetic stirring means for inducing in molten metal a primary circulatory flow in a rotational sense opposite that induced by said first-recited magnetic stirring means.

8. An apparatus as recited in claim 7 wherein said additional magnetic means comprises:

at least one additional magnetic means located upstream of said first-recited magnetic stirring means;

and at least one additional magnetic means located downstream of said first-recited magnetic stirring means.

9. An apparatus as recited in claim 1 and comprising:

an upstream end on said mold;

a linear conduit composed of refractory material and extending between said outlet of the chamber and said inlet of the mold, for confining molten metal flowing from said chamber into said mold;

means enclosing said upstream end of the mold from the atmosphere outside said mold;

said mold comprising means for solidifying a solid peripheral skin around the molten metal in said mold;

and means for preventing said solid peripheral skin in the mold from extending upstream, in the direction of said enclosed upstream end, beyond a predetermined location.

10. An apparatus as recited in claim 1 and comprising:

magnetic stirring means disposed around the outside of said mold;

said mold being cylindrical and having a diameter no more than about 150 mm (6 in.) and a wall thickness between about 1.6 and 4.8 mm (1.16–3/16 in.);

said mold being composed of a metallic material having a conductivity no greater than about $0.29\times10^{8}$ $(\text{ohm m})^{-1}$.

11. An apparatus for use in the casting of molten metal, said apparatus comprising:

a casting mold having an upstream end, an inlet at said upstream end and an outlet;

means enclosing said upstream end of the mold from the atmosphere outside said mold;

a chamber located upstream of said mold and having an inlet for receiving molten metal and an outlet linearly aligned with said inlet of the mold;

magnetic stirring means disposed around said chamber;

a conduit composed of refractory material and extending between said outlet of the chamber and said inlet of the mold, for confining molten metal flowing from said chamber into said mold;

said mold comprising means for solidifying a solid peripheral skin around the molten metal in said mold;

and first preventing means for preventing said solid peripheral skin in the mold from extending upstream, in the direction of said enclosed upstream end, beyond a predetermined location.

12. An apparatus as recited in claim 11 wherein:

said conduit has a downstream end;

said mold has an upstream end;

and said first preventing means comprises a ceramic break ring sandwiched between the downstream end of said conduit and the upstream end of said mold.

13. An apparatus as recited in claim 11 wherein:

said conduit includes a portion extending downstream into said mold and having an outer surface;

said mold includes an upstream portion having an inner surface;

said outer surface on the downstream portion of the conduit and said inner surface on the upstream portion of the mold define a substantially annular space therebetween;

and said first preventing means comprises means for introducing a pressurized inert gas into said space to prevent molten metal in said mold from entering said space.

14. An apparatus as recited in claim 13 and comprising:

magnetic stirring means disposed around said mold and which creates turbulence in the molten metal in said mold;

and second preventing means for preventing said turbulence from splashing molten metal upstream into said space adjacent said interior surface of the mold's upstream portion.

15. An apparatus as recited in claim 14 wherein said second preventing means comprises:

lip means composed of refractory material and extending inwardly from said interior surface, adjacent the downstream end of said space.

16. An apparatus as recited in claim 11 wherein:

said chamber comprises heat-extracting means capable of forming a solid peripheral skin around the molten metal in said chamber;

and said apparatus comprises additional preventing means for preventing any solid peripheral skin which forms in said chamber from growing downstream into said conduit.

17. An apparatus as recited in claim 16 wherein said additional preventing means comprises:

a constriction at said outlet of the chamber.

18. An apparatus for use in the casting of molten metal, said apparatus comprising:

means for confining a volume of molten metal flowing downstream;

said confining means having upstream and downstream ends;

magnetic stirring means, disposed around said confining means, for inducing, in said downstream-flowing volume of molten metal, primary circulatory flow in a first rotational sense;

and a plurality of means for substantially reducing secondary recirculating flows caused in said volume of molten metal by said magnetic stirring means, to conserve the stirring energy available from said primary circulatory flow;

said plurality of means comprising (a) additional magnetic means located upstream of said magnetic stirring means and (b) means, located downstream of said magnetic stirring means, which is at least as close to said stirring means as the downstream end of said confining means.

19. An apparatus as recited in claim 18 wherein said means for substantially reducing said secondary recirculating flows comprises:

at least one additional magnetic means aligned with and spaced from said first-recited magnetic stirring means and comprising either (a) magnetic brake means or (b) another magnetic stirring means for inducing, in said downstream-flowing volume of molten metal, primary circulatory flow in a rotational sense opposite that induced by said first-recited magnetic stirring means.

20. An apparatus as recited in claim 19 wherein said additional magnetic means comprises:

at least one additional magnetic means located upstream of said first-recited magnetic stirring means;

and at least one additional magnetic means located downstream of said first-recited magnetic stirring means.

21. An apparatus as recited in claim 20 wherein said confining means is a casting mold.

22. An apparatus for use in the continuous casting of molten metal, said apparatus comprising:

a cylindrical casting mold having an inlet and an outlet;

magnetic stirring means disposed around the outside of said mold;

said mold having a diameter no more than about 150 mm (6 in.) and a wall thickness between about 1.6 and 4.8 mm (1/16–3/16 in.);

and said mold being composed of a metallic material having a conductivity no greater than about $0.29\times10^8$ (ohm m)$^{-1}$.

23. An apparatus as recited in claim 22 wherein:

said mold allows at least 50% of the magnetic field developed by said magnetic stirring means to penetrate to the interior of said mold when employing an electromagnetic frequency of about 60 Hertz.

24. An apparatus as recited in claim 23 and which provides a skin depth for the magnetic field in the mold of at least 12.7 mm (½ in.) when employing an electromagnetic frequency of about 60 Hertz.

25. An apparatus as recited in claim 22 wherein:

said mold is composed of a metallic material consisting essentially of, in wt. %:

| | |
|---|---|
| Be | 0.55 |
| Co | 2.4 |
| Zr | 0.25 |
| Cu | balance. |

26. A method for use in the casting of molten metal, said method comprising the steps of:

providing a column of molten metal flowing downstream, and confining at least a portion of said column, said confined portion having upstream and downstream ends;

magnetically stirring said column, at a first location between said ends of said confined column portion, to induce in the molten metal at said first location a primary circulatory flow in a first rotational sense;

and a plurality of steps for substantially reducing secondary recirculating flow caused by said magnetic stirring;

said plurality of steps comprising (a) magnetically affecting said column at a location upstream of said first location and (b) reducing said secondary recirculating flow at a location, downstream of said first location, which is at least as close to said first location as the downstream end of said confined column portion.

27. A method as recited in claim 26 wherein said step of substantially reducing secondary recirculating flows comprises performing at least one of the following procedures:

(a) magnetically stirring the molten metal at a location spaced from said first location to induce in said molten metal at a second location, at which said secondary recirculating flow occurs, primary circulatory flow in a rotational sense opposite that of said primary circulatory flow at said first location; and (b) magnetically braking said first-recited secondary recirculating flow at said second location.

28. A method as recited in claim 27 wherein:

one of said procedures is performed at a location upstream of said first location;

and one of said procedures is performed at a location downstream of said first location.

29. A method for use in the casting of molten metal, said method comprising the steps of:

providing a column of molten metal flowing downstream;

magnetically stirring said column, at a magnetic stirring zone having upstream and downstream ends, to induce in the molten metal in said magnetic stirring zone a primary circulatory flow in a first rotational sense;

and a plurality of steps for substantially reducing secondary recirculating flow caused by said magnetic stirring;

said plurality of steps comprising constricting said column at a first constricting location not substantially further upstream than said upstream end of the magnetic stirring zone;

and constricting said column at a second constricting location not substantially further downstream than said downstream end of the magnetic stirring zone.

30. A method as recited in claim 29 wherein:

said column has a cross-sectional area at each of said constricting locations substantially less than the cross-sectional area of said column between said constricting locations.

31. A method as recited in claim 30 wherein:

said cross-sectional area of the column at each of said constricting locations is between about one-fourth and about one-half of said cross-sectional area of said column between said constricting locations.

32. A method for rheocasting molten metal to produce a degenerate, dendritic microstructure comprising substantially spheroidal grains, said method comprising:

providing a column of molten metal flowing downstream;

confining said column to a substantially circular cross-section;

subjecting said column of molten metal to electromagnetic agitation in a stirring zone;

allowing said molten metal to cool as it flows downstream through said stirring zone;

said method being conducted in accordance with the following equation—

$$\frac{LBR}{Q}\left(\frac{\sigma\omega}{\rho}\right)^{\frac{1}{2}} > 1{,}000$$

where:

B is the magnetic field strength, in Tesla

R is the radius, in meters, of the molten metal column undergoing stirring in the stirring zone $\sigma$ is the electrical conductivity of the molten metal, in (ohm meters)$^{-1}$ $\omega$ is the angular frequency of the stirring in the stirring zone, in radians/second $\rho$ is the density of the molten metal, in kg/m$^3$ L is the latent heat of fusion of the molten metal, in Joules/$m^3$ Q is the rate of heat extraction from the molten metal in the stirring zone, in Watts/$m^2$.

33. A method as recited in claim 32 wherein:

$$\frac{RL}{Q} < 2500\ S.$$

34. A method as recited in claim 33 wherein:

$$RL/Q < 100\ S.$$

35. An apparatus for use in the continuous casting of molten metal, said apparatus comprising:

a casting mold having an inlet and an outlet;

a chamber located upstream of said mold and having an inlet for receiving molten metal and an outlet vertically aligned with said inlet of the mold;

said casting mold having a constricted cross-section compared to the cross-section of said chamber;

first magnetic means, disposed around said chamber in close proximity thereto, for stirring the molten metal in said chamber;

and second magnetic means, disposed around said casting mold in close proximity thereto;

said second magnetic means being separate and discrete from said first magnetic means.

* * * * *

UNITED STATES PATENT AND TRADEMARK OFFICE

CERTIFICATE OF CORRECTION

PATENT NO. : 5,178,204

DATED : January 12, 1993

INVENTOR(S) : James E. Kelly et al.

It is certified that error appears in the above-identified patent and that said Letters Patent is hereby corrected as shown below:

Column 12, line 27, delete "meal" and insert --metal--;

Column 13, line 35, delete "1.16" and insert --1/16--.

Signed and Sealed this

Ninth Day of May, 1995

*Attest:*

Bruce Lehman

BRUCE LEHMAN

*Attesting Officer*

*Commissioner of Patents and Trademarks*